US006971688B2

(12) United States Patent
Drysdale et al.

(10) Patent No.: US 6,971,688 B2
(45) Date of Patent: Dec. 6, 2005

(54) INERTIA LOCKING MECHANISM

(75) Inventors: Stephen Drysdale, Northampton (GB); Keith Sanders, Hingham (GB); Glenn Cotter, Droitwich (GB); Jagjit Golar, Hall Green (GB); Morten Ketelsen, Birmingham (GB); Nigel Spurr, Shirley (GB); Gurbinder Kalsi, Oldbury (GB); Peter Coleman, Birmingham (GB)

(73) Assignee: ArvinMeritor Light Vehicle Systems (UK) Ltd., West Midlands (GB)

( * ) Notice: Subject to any disclaimer, the term of this patent is extended or adjusted under 35 U.S.C. 154(b) by 28 days.

(21) Appl. No.: 10/609,342

(22) Filed: Jun. 27, 2003

(65) Prior Publication Data

US 2004/0046400 A1 Mar. 11, 2004

(30) Foreign Application Priority Data

Jun. 27, 2002 (GB) ..... 0214817

(51) Int. Cl.[7] ..... E05C 3/06
(52) U.S. Cl. ..... 292/216; 292/DIG. 22
(58) Field of Search ..... 292/336.3, 216, 292/201, DIG. 22, DIG. 65; 16/412

(56) References Cited

U.S. PATENT DOCUMENTS 4,326,111 A 4/1982 Jackman
4,536,021 A * 8/1985 Mochida ..... 292/201
4,616,862 A * 10/1986 Ward ..... 292/201
5,253,906 A * 10/1993 Rogers et al. ..... 292/216
5,308,130 A 5/1994 Lee
5,865,481 A 2/1999 Buschmann
6,070,923 A * 6/2000 Tanimoto et al. ..... 292/336.3

FOREIGN PATENT DOCUMENTS

| | | | |
|---|---|---|---|
| DE | 1653964 | A | 3/1972 |
| DE | 41 17 110 | C1 | 12/1992 |
| DE | 199 12 680 | A1 | 12/1992 |
| EP | 0744519 | A1 | 11/1996 |
| GB | 1 161 602 | A | 8/1969 |
| GB | 1 214 884 | A | 12/1970 |

OTHER PUBLICATIONS

International search report, dated Oct. 11, 2002.
European Search Report, Jun. 1, 2004.

* cited by examiner

*Primary Examiner*—Gary Estremsky
(74) *Attorney, Agent, or Firm*—Carlson, Gaskey & Olds

(57) ABSTRACT

A door latch mechanism for a vehicle comprising a release lever operable by a door handle and a transmission path linkage containing a resiliently biased inertia device. During normal operation, the inertia device is biased to form a transmission path that transmits an unlatching movement from the release lever to release a latch bolt of the latch. If an impact on the vehicle creates an acceleration force above a predetermined level, the inertia device moves to break the transmission path, preventing the latch from being unlatched.

9 Claims, 14 Drawing Sheets

INERTIA LOCKING MECHANISM

REFERENCE TO RELATED APPLICATIONS

The present invention claims priority to United Kingdom Patent Application No. 0214817.9, filed Jun. 27, 2002.

TECHNICAL FIELD

The present invention relates to a vehicle door latch mechanism. More particularly, the present invention relates to an inertia locking mechanism for a vehicle door latch incorporating an inertia device that is movable in response to vehicle acceleration to lock the latch.

BACKGROUND OF THE INVENTION

During an impact with another body, vehicle passenger doors may deform. This deformation may cause components in a linkage between a door handle and a vehicle door latch to change their relative positions. This potentially results in an unwanted unlatching of the latch due to, for example, the linkage stretching and thus moving a release lever of the latch. In such a crash or impact situation, unlatching of vehicle passenger doors is undesirable because the latched doors provide a large proportion of the structural integrity of the vehicle, whereas unlatched doors do not. Additionally, unlatching of a door during an impact increases the risk of vehicle occupants being thrown from the vehicle, leading to an increased risk of injury.

SUMMARY OF THE INVENTION

The present invention seeks to overcome, or at least mitigate the problems of the prior art.

Accordingly, one embodiment of the present invention is a door latch mechanism for a vehicle comprising a release lever operable by a door handle and a transmission linkage having a resiliently biased inertia device. During normal operation, the inertia body is arranged to transmit unlatching movement from the release lever to release a latch bolt of the latch. If the vehicle undergoes acceleration (which includes both positive and negative acceleration values) above a predetermined level, the inertia of the inertia body in the latch mechanism causes an interruption to be created in the transmission linkage.

Another embodiment of the invention includes an inertia locking mechanism for a vehicle door latch having an electrical transmission signal path normally operable by a door handle to release a latch bolt of a vehicle door latch. The transmission path comprises an electrical component that causes an interruption in the transmission path if a vehicle undergoes acceleration above a predetermined level.

BRIEF DESCRIPTION OF THE DRAWINGS

Embodiments of the present invention will now be described, by way of example only, with reference to the drawings in which.

DETAILED DESCRIPTION OF THE PREFERRED EMBODIMENTS

Figure 15:
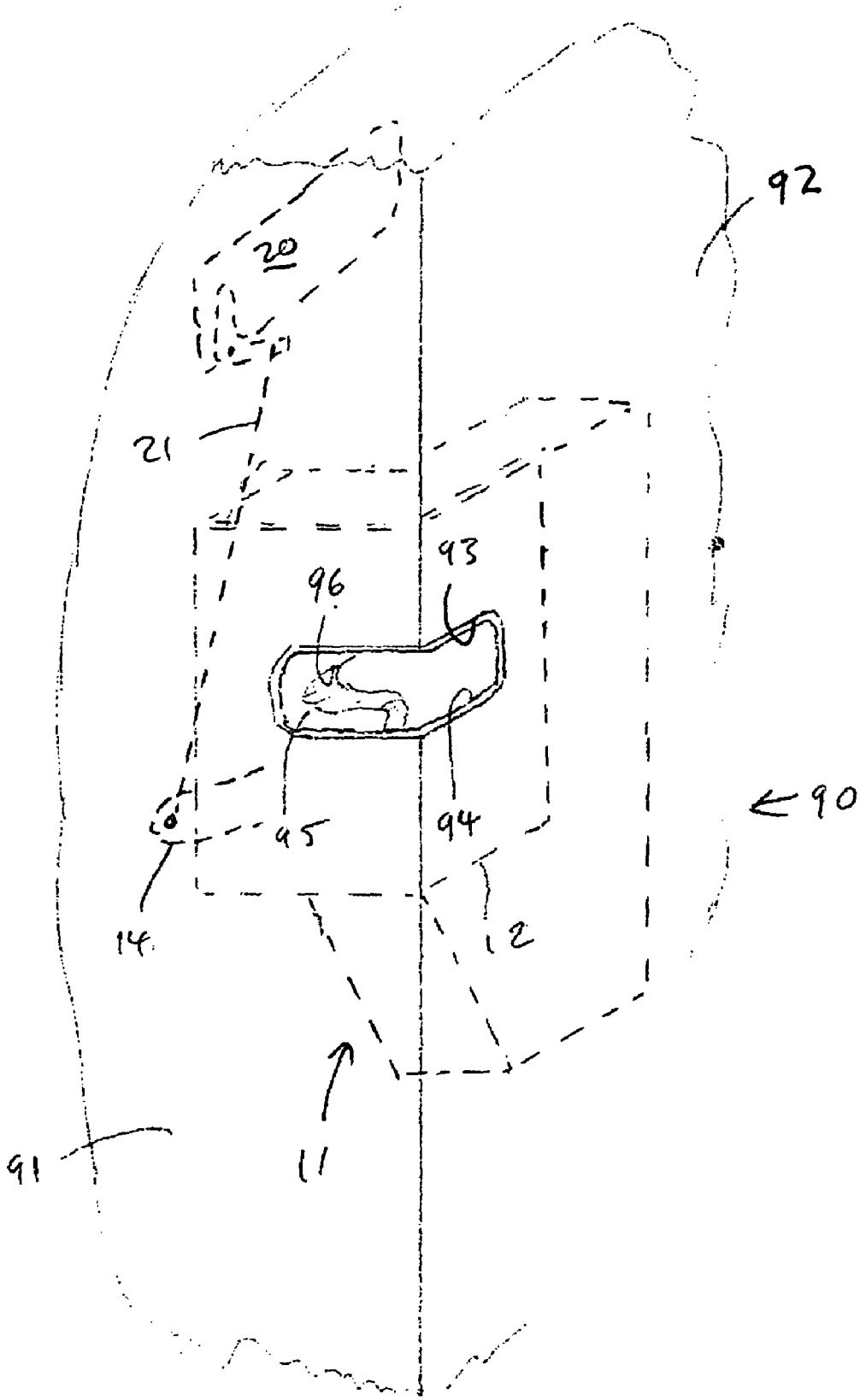
FIG. 15 is a perspective view of a vehicle passenger door incorporating a latch including a mechanism according to an embodiment of the present invention.

Referring to FIG. 15, a latch 11 is mounted to a vehicle side passenger door 90 at the intersection of a shut face 91 (at the door trailing edge) and inside face 92 thereof. A portion of the door is cut away to provide an opening 93 spanning the intersection. The opening is capable of receiving a striker (not shown) mounted to a fixed portion of the vehicle, such as a door pillar (not shown). A similarly dimensioned opening 94 is also provided in a chassis 12 of the latch 11. An outside release lever 14 of the latch 11 is connected to an outside handle 20 of the door 90 by a linkage 21.

Figure 16:
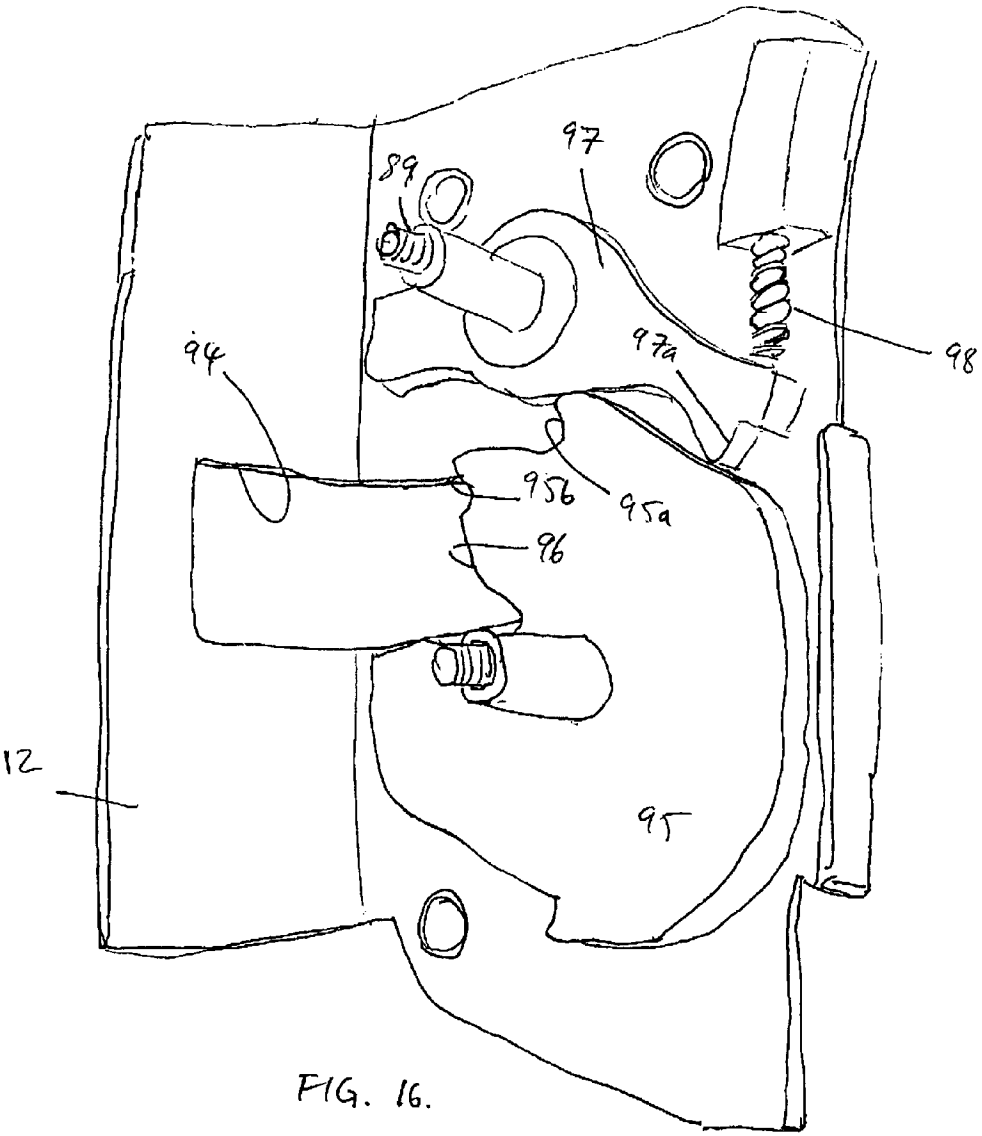
FIG. 16 is a perspective view of the latch of FIG. 15 in a partially assembled state.

Referring now to FIG. 16, a latch bolt in the form of a rotatable claw 95 (also partially visible in FIG. 15) is pivotally mounted to an inner face of the chassis 12 by a pivot pin and is arranged to receive the striker in a mouth 96 thereof. In FIGS. 15 and 16, the claw 95 is shown in a released state. The claw 95 is biased into an open position by a resilient means, such as a spring (not shown). However, because the biasing force causes claw 95 to rotate by relative movement between the striker and latch 11 during closure of the door 90, the claw 95 may be retained by a latch pawl 97 by engaging a pawl tooth 97*a* on the pawl 97 with either a first safety abutment 95*a* or a fully latched abutment 95*b* on a periphery of the claw 95. The latch pawl 97 is pivotally mounted about a second pivot pin 89 and is resiliently biased by a spring 98 into contact with the claw 95.

Figure 17:
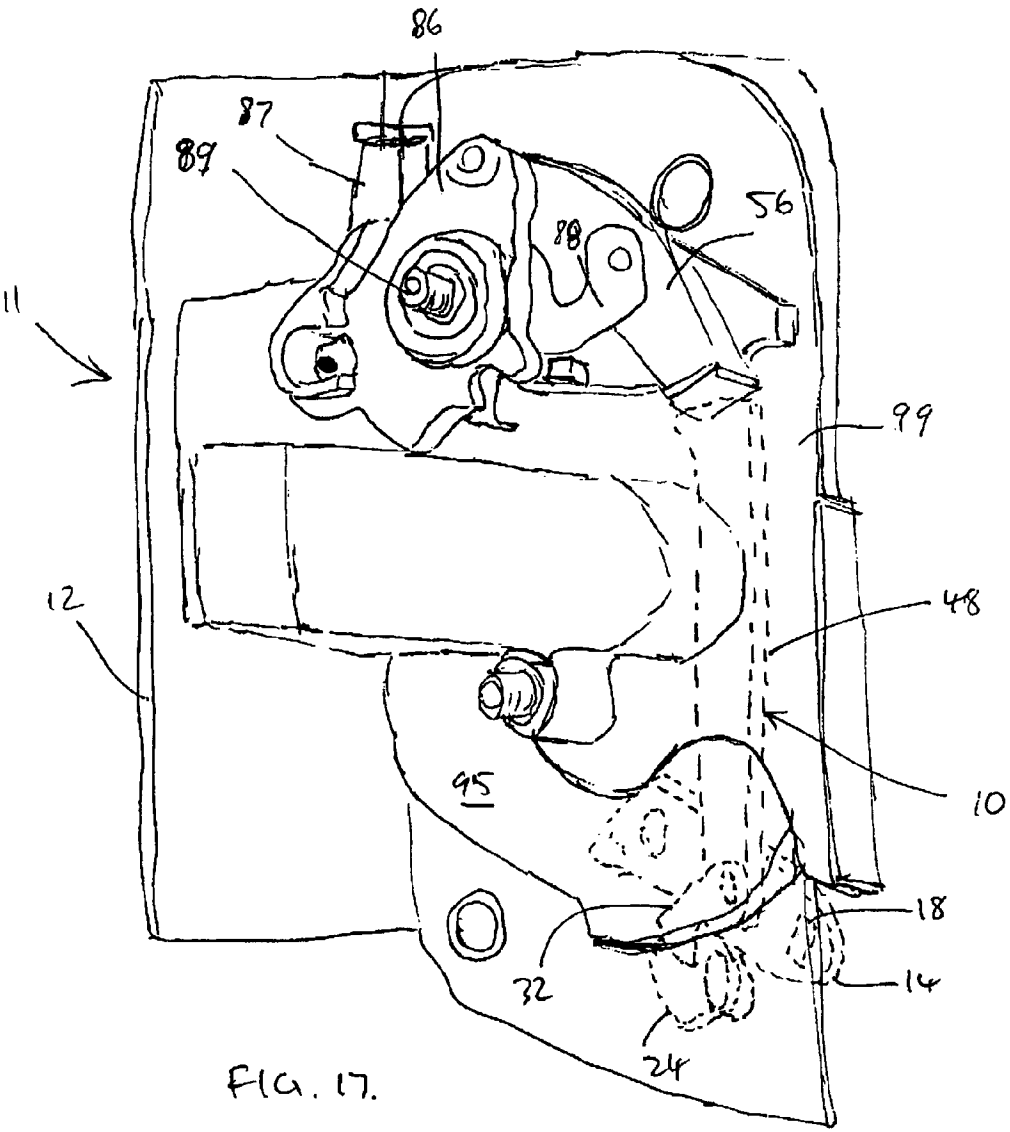
FIG. 17 is a perspective view of the latch of FIG. 15 at a later stage of assembly.

FIG. 17 shows a cover plate 99 placed on the latch to partially obscure the claw 95 and completely obscure the latch pawl 97. The cover plate 99 further shrouds the opening 94 in the latch chassis 12 to minimize the ingress of dirt etc. into the latch 11 through the opening 94.

An outside actuating lever 56 is pivotably connected to a release link connoctor 88 by a pin. The release link connector 88 extends from a pawl lifter (not shown). The pawl lifter rotates about a pin 89 and has a lost motion connection to the pawl 97 so that the pawl lifter is capable of disengaging the pawl 97 from the claw 95. The inside actuating lever 87 is similarly connected to the pawl lifter. The pawl lifter and the connector 88 rotate together about a pin 89. The pawl lifter is biased in a clockwise direction by a spring(not shown). Rotation of a man lock lever 86 in a clockwise direction causes actuating levers 56 and 87 to rotate clockwise by the action of a cam portion (not shown) of the main lock lever 86 and move to a locked position.

Actuating levers 56 and 87 are biased in an counter-clockwise direction by a spring (not shown) so that when the main lock lever 86 returns to the unlock position, the links 56 and 87 also return to their unlocked positions.

Figure 1:
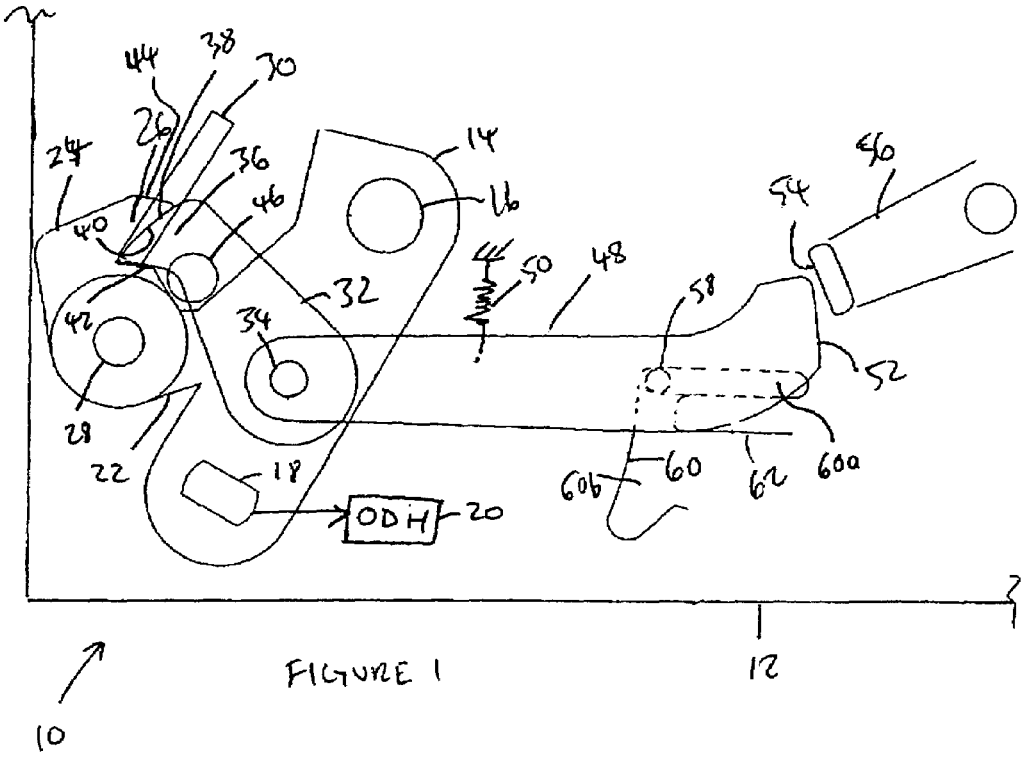
FIG. 1 is a schematic view of a latch according to one embodiment of the present invention showing a transmission linkage in a rest position.

Referring to FIGS. 1 and 17, a mechanism of the latch 11 indicated generally by reference numeral 10 (shown in broken lines in FIG. 17) comprises a number of latch components mounted to another portion of the latch chassis 12 visible in FIG. 15. The mechanism is positioned on top of the cover plate 99 to be capable of actuating the actuating lever 56. The components include the release lever 14, which is pivotally mounted to the chassis 12 by a pin 16 at one end and has a slotted aperture 18 at its other end for connection to the outside door handle (illustrated schematically at 20 in FIG. 1). A limb 22 extends from one side of the release lever 14 and has a catch 24 having a tooth 26 mounted pivotally thereon. The catch 24 is pivotally mounted about a pin 28 and is biased in a clockwise direction as shown in FIG. 1. A ramp surface 30 is secured to a tooth 26 and projects into the paper when viewed from the perspective shown in FIG. 1.

An inertia body or device, such as an inertia pawl 32, is pivotally mounted to the release lever 14 by a pin 34 positioned between the pin 16 and aperture 18 on the release lever 14. The inertia pawl 32 is biased in a counter-clockwise direction. The inertia pawl 32 comprises a pawl tooth 36 arranged to engage the tooth 26 of the catch 24 via an end surface 38 of the inertia pawl 32 and an inner surface 40 of the catch tooth 26. The pawl tooth 36 further includes an inner surface 42 and the catch tooth 26 further includes an end surface 44.

A fixed projection 46 extends from the chassis 12 and is positioned to engage the ramp surface 30 during a pivoting motion of the release lever 14, as will be discussed in further detail below.

A transmission lever 48 is further pivotally mounted to the pin 34 on the release lever 14. The transmission lever 48 is rotationally coupled with the inertia pawl 32 and is therefore also biased in a counter-clockwise direction by a biasing means, such as a tension spring 50. An abutment surface 52 is provided at the end of the transmission lever 48 remote from the pin 34 so that during normal operation, the abutment surface may contact a corresponding abutment surface 54 of an actuating lever 56 when the actuating lever is in an unlocked position as shown in FIG. 17. It will be appreciated that when the transmission lever 48 is fitted to the trailing edge of a vehicle side passenger door as shown in FIG. 1, the pivotal axis of the transmission lever 48 is substantially parallel to the longitudinal (i.e. front to rear) axis of the vehicle and the vehicle door as well as the axis of rotation of the claw 95 and the latch pawl 97.

A projection 58 is provided on one face of the transmission lever 48. The projection 58 fits in a slot or recess 60 provided in the chassis 12. During normal operation, the projection 58 may slide along a linear slot portion 60*a*, which is arranged to extend substantially parallel to the longitudinal axis of the transmission lever 48. The projection is biased towards the upper surface of the slot portion 60*a* by a spring 50. However, the projection 58 may also move along an arcuate slot portion 60*b* as die transmission lever 48 pivots about the pin 34, coming to rest in the position shown in FIG. 2. Thereafter, the projection 58 may move to the positions shown in FIG. 4 (lever return position) and FIG. 5 (full travel position) to come to rest along the abutment surface 62, which extends substantially parallel to the slot portion 60*a*. It should be noted that when the projection 58 is at rest along the abutment surface 62, the abutment surface 52 of the transmission lever 48 cannot contact the abutment surface 54 of the actuating lever 56.

Under normal operating conditions where the latch starts in a latched, unlocked condition, the latch operates as follows:

The vehicle user pulls on the outside door handle 20, causing the release lever 14 to pivot in a counter-clockwise direction against its biasing force. In turn, this causes transmission lever 48 to move from left to right as viewed in FIG. 1 (vertically when fitted to a door 90), with the projection 58 sliding in the slot portion 60*a* such that the abutment surface 52 of the transmission lever 48 contacts the abutment surface 54 or the actuating lever 56. Contact between the two abutment surfaces 52 and 54 displaces the actuating lever 56 and causes the latch pawl 97 to lift clear of the claw 95, unlatching the latch. When the outside door handle 20 is released, the transmission linkage returns to the rest position shown in FIG. 1, thereby enabling the latch mechanism 10 to re-latch.

Figure 2:
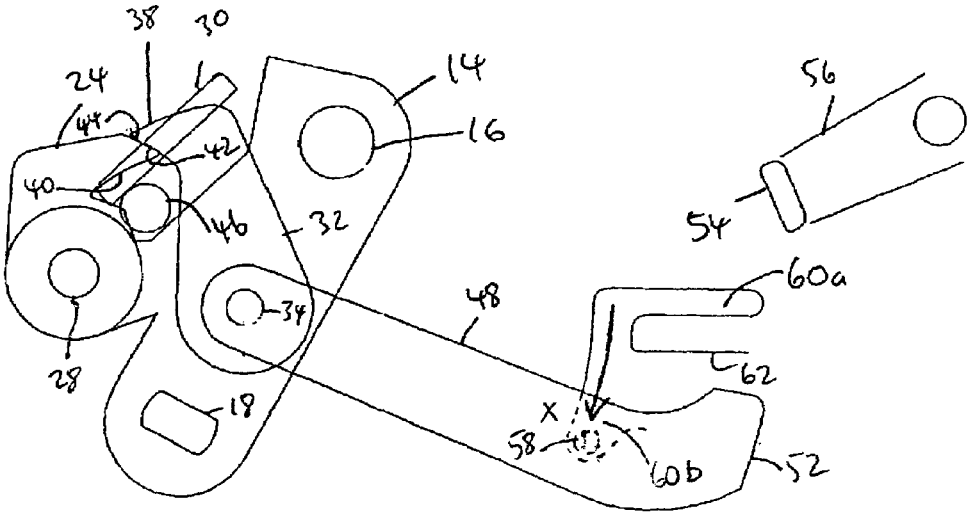
FIG. 2 shows the transmission linkage of FIG. 1 in a locked position.
Figure 3:
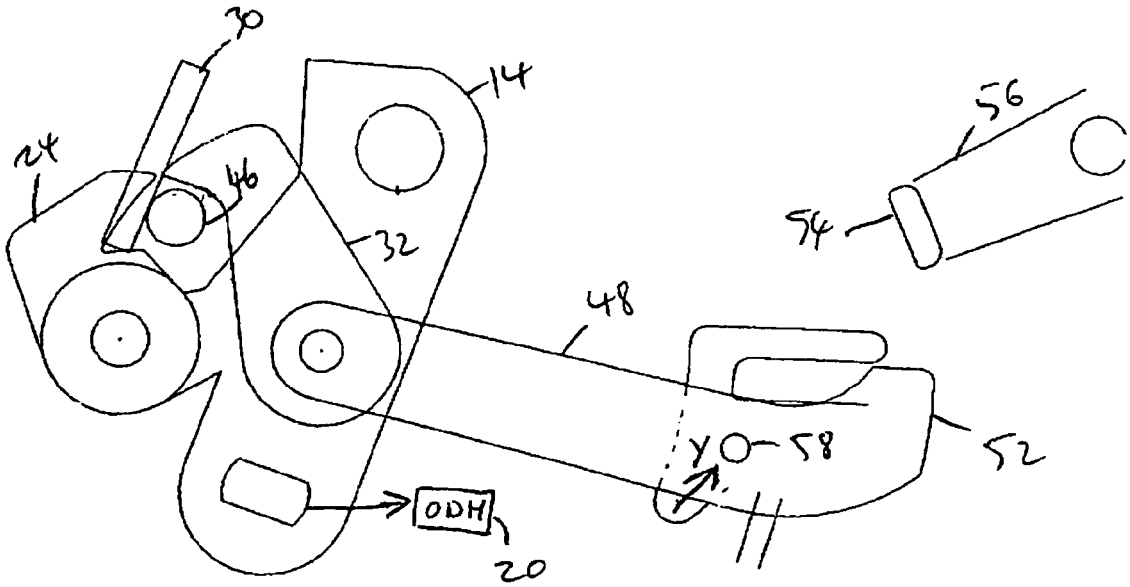
FIG. 3 shows the linkage of FIG. 1 in a pawl lifted condition.

FIG. 2 illustrates a situation where the vehicle to which latch mechanism 10 is fitted has suffered an impact with a sufficient transverse component of acceleration (e.g., an impact from the side) to cause the inertia of transmission lever 48 to overcome the resilient biasing force of the spring 50. As a result, the transmission lever 48 pivots in the direction of arrow X relative to the remainder of the latch to bring the projection 58 into the position shown in FIG. 2. Because the transmission lever 48 is rotationally coupled with the inertia pawl 32, the inertia pawl 32 also pivots in a clockwise direction. This causes the end surface 38 of the inertia pawl 32 to slide out of contact with the inner surface 40 of the catch tooth 26, thereby allowing the catch 24 to rotate clockwise. The end surface 44 of the catch tooth 26 thus comes into contact with inner surface 42 of the inertia pawl 32 and retains the transmission lever 48 in the position shown in FIG. 2 against the biasing force of the spring 50. In a typical impact, this movement may occur in 8 to 12 milliseconds and prevent the abutment surface 52 of the transmission lever 48 from contacting the abutment surface 54 of the actuating lever 56 due to unwanted deformation of the door.

Figure 4:
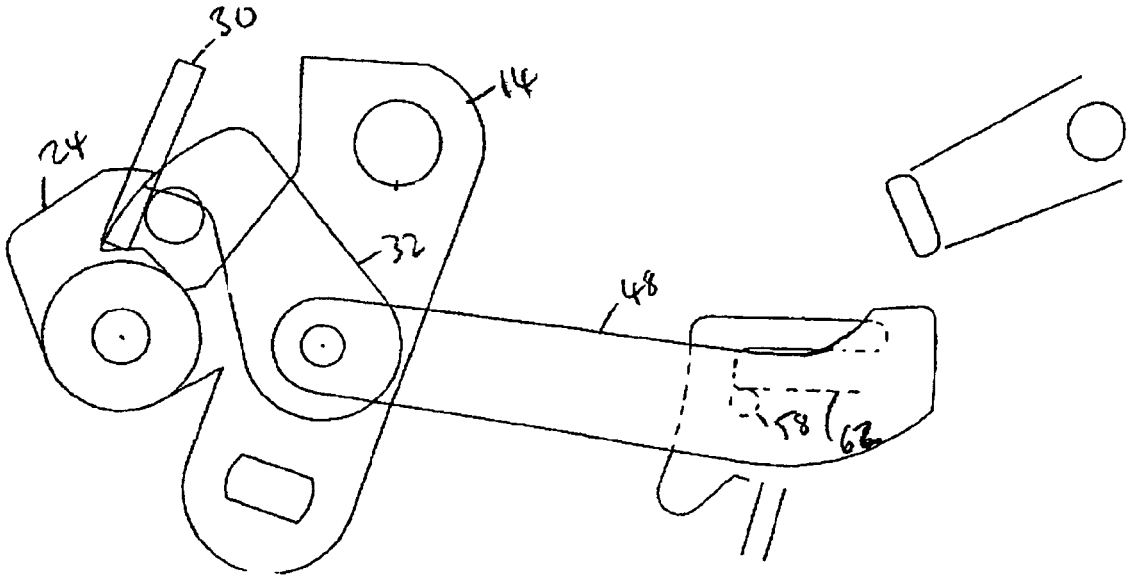
FIG. 4 shows the linkage of FIG. 1 in a lever return position.

After the impact occurs, a single pull on the outside door handle 20 causes the release lever 14 and the catch 24 to pivot about the pin 16. This pivoting motion causes the fixed projection 46 from the chassis 12 to contact the ramp surface 30 and forces the catch 24 to rotate counter-clockwise about the pin 28 relative to the release lever 14. As shown seen in FIGS. 2 and 4, this causes the inner surface 42 of the inertia pawl 32 to free itself from contact with the end surface 44 of the catch 24, enabling the projection 58 to move upwardly in a direction shown by arrow Y as it is also being moved to the right under the influence of a pivoting movement of the release lever 14 about the pin 16. This movement continues until the projection 58 comes to rest on the abutment surface 62 of the slot or recess 60, as shown in FIG. 4.

Figure 5:
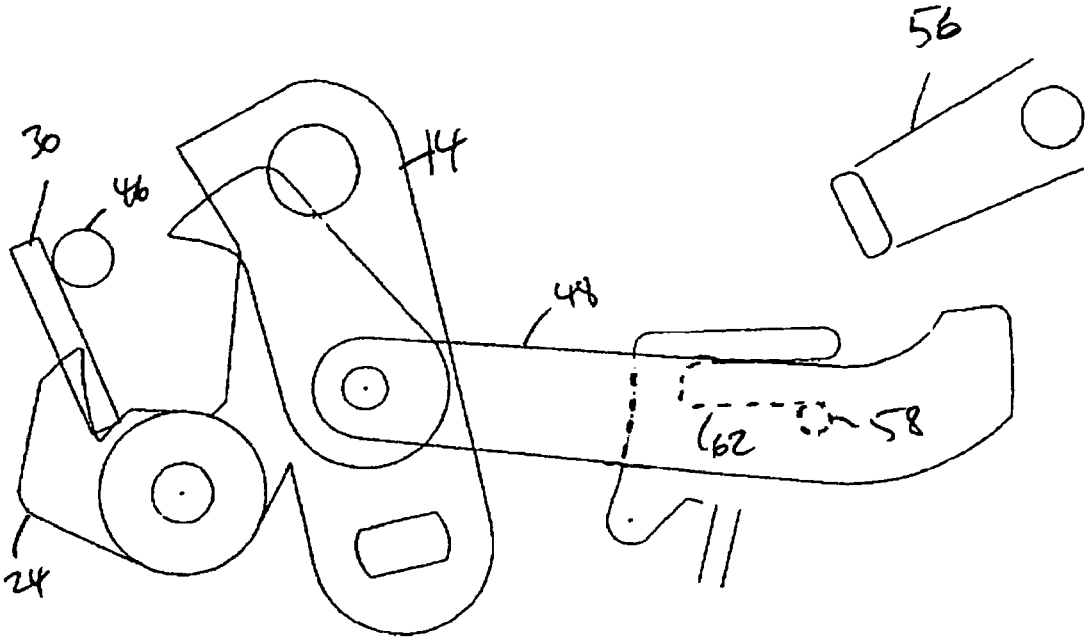
FIG. 5 shows the linkage of FIG. 1 in a full travel position.

If the outside door handle 20 is pulled to its full extent of travel, the projection 58 on the transmission lever 48 will reach the position on the abutment surface 62 shown in FIG. 5. However, once the outside door handle 20 is released, the biasing of the release lever 14 and the transmission lever 48 will cause the projection 58 to slide to the left along the abutment surface 62 before moving upwards to return to the rest position shown in FIG. 1.

A subsequent pull on the outside door handle then enables the latch mechanism 10 to be released in the normal way, with the abutment surface 52 of the transmission lever contacting the abutment surface 54 of the actuation lever 56. This resetting feature of the transmission linkage enables the latch to be continue to be used normally even after an impact. In particular, it enables the door to be opened to enable emergency personnel to enter the vehicle if the vehicle occupants are injured in the impact (assuming that this is not prevented by excessive deformation of the door to which the latch is fitted).

FIGS. 6 to 9 illustrate another embodiment of the present invention. Similar parts among the different embodiments have been designated by like numerals with the addition of the prefix "1" wherever possible. Differences between the latch of the second embodiment with respect of the latch of the first are discussed in further detail below.

Figure 6:
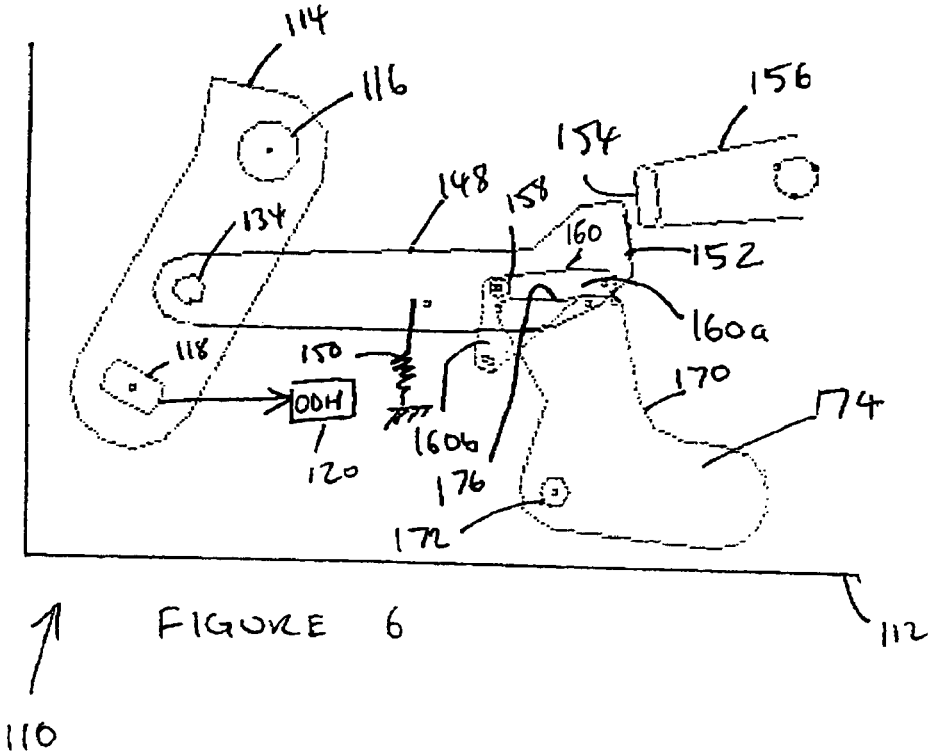
FIG. 6 is a schematic view of a latch mechanism according to another embodiment of the present invention showing a transmission linkage in a rest position.
Figure 7:
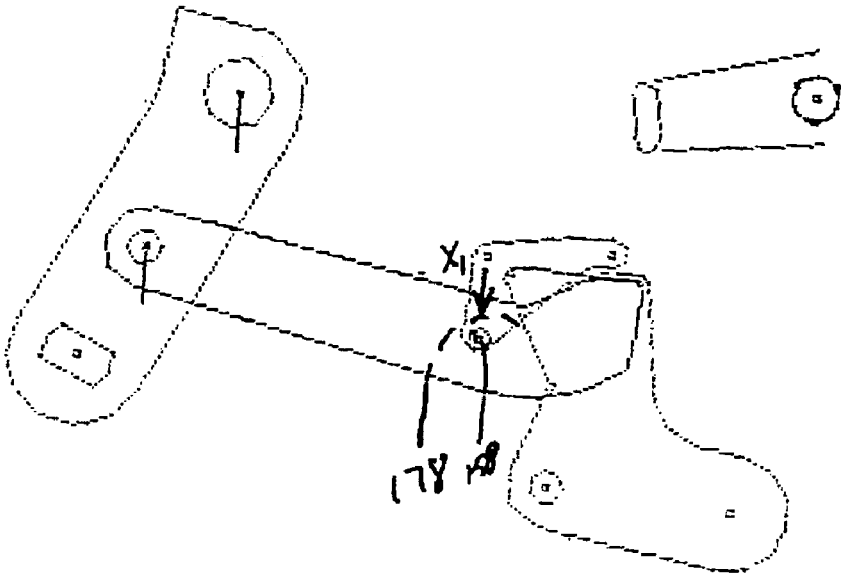
FIG. 7 shows the linkage of FIG. 6 in a locked position.

As shown in FIG. 6, the pawl and catch arrangement of the first embodiment has been dispensed with. In contrast with the transmission lever 48 of the first embodiment, the transmission lever 148 in the second embodiment is biased in a clockwise direction by a tension spring 150. The slot 160 is substantially triangular in shape. During normal operation, the projection 158 on the transmission lever 148 is maintained in an upper region of the slot 160 by an inertia body 170 pivotally mounted about a pin 172.

The inertia body 170 is resiliently biased in a counter-clockwise direction and is shown in its rest position in FIG. 6. An upper surface 176 of the inertia body 170 defines, together with the upper surface of the slot 160, an elongate slot portion 160*a* similar to the slot portion 60*a* of the first embodiment. However, due to the clockwise biasing of the transmission lever 148 in this embodiment, the projection 158 tends to contact the surface 176 of the inertia body 170 during movement along the slot portion 160*a*.

The inertia body 170 further comprises an inertia mass portion 174 remote from pin 172.

During normal operation, a vehicle user pulls on the outside door handle 120, causing the transmission lever 148 to move substantially linearly towards the actuating lever 156 while being guided by the movement of the projection 158 on the transmission lever 148 in a slot portion 160*a*. The abutment surface 152 of the transmission lever 148 contacts the abutment surface 154 of the actuating lever 156 to actuate the actuating lever 156, thereby causing the latch to be released.

If the vehicle is involved in an impact, resulting in a transverse component of acceleration above a predetermined value, the inertia body 170 pivots about the pin 172 in a clockwise direction relative to the remainder of the latch. This occurs due to the tendency of the inertia mass portion 174 to remain stationary in the transverse direction while the rest of the vehicle accelerates. In the rest position, the spatial relationship between the upper surface 176 of the inertia body 170, the projection 158 on the transmission lever 148, the pin 172 and the slot 160 is such that the inertia mass portion 174 may rotate without interfering with the projection 158. Once the inertia body 170 has rotated, the transmission lever 148 rotates in a clockwise direction as indicated by arrow X under the influence of the spring 150 to come to rest in the position shown in FIG. 7. Once the acceleration has ceased, the inertia body 170 rotates counter-clockwise to return to its rest position under the influence of its biasing.

Figure 8:
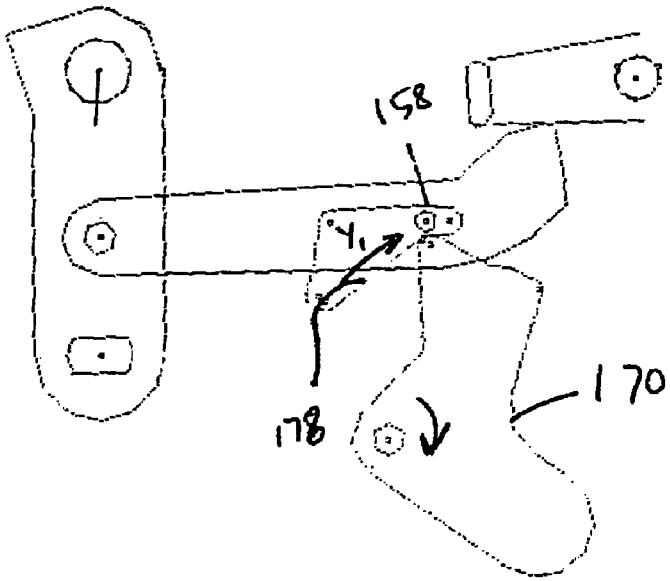
FIG. 8 shows the linkage of FIG. 6 in a resetting position.
Figure 9:
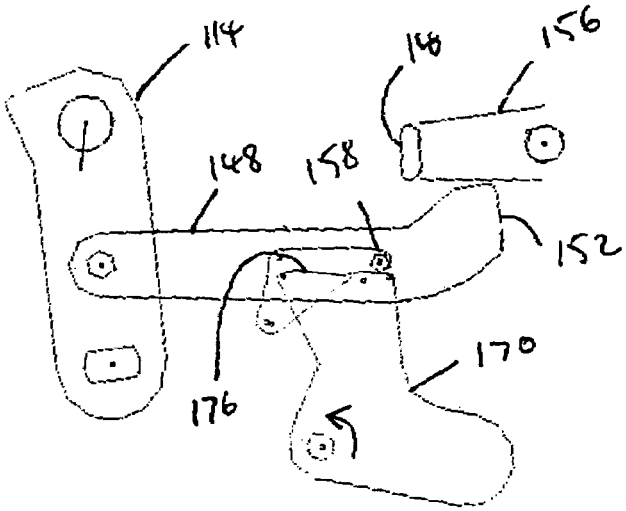
FIG. 9 shows the linkage of FIG. 6 in a full travel position.

When the outside door handle 120 is then pulled, the projection 158 follows the surface 178 of the slot 160 in a direction shown by arrow Y in FIG. 8. This causes the abutment surface 152 on the transmission lever 148 to miss contacting the abutment surface 154 or the actuating lever 156. This movement also causes the inertia body 170 to rotate in a clockwise direction, allowing the projection 158 to pass by it, before returning to its rest position shown in FIG. 9. Thus, once the handle 120 is released, the projection 158 follows the surface 176 in the slot 160 and returns to the rest position shown in FIG. 6. From this position, a further pull on the outside door handle 120 will cause the transmission linkage to operate normally.

Figure 10:
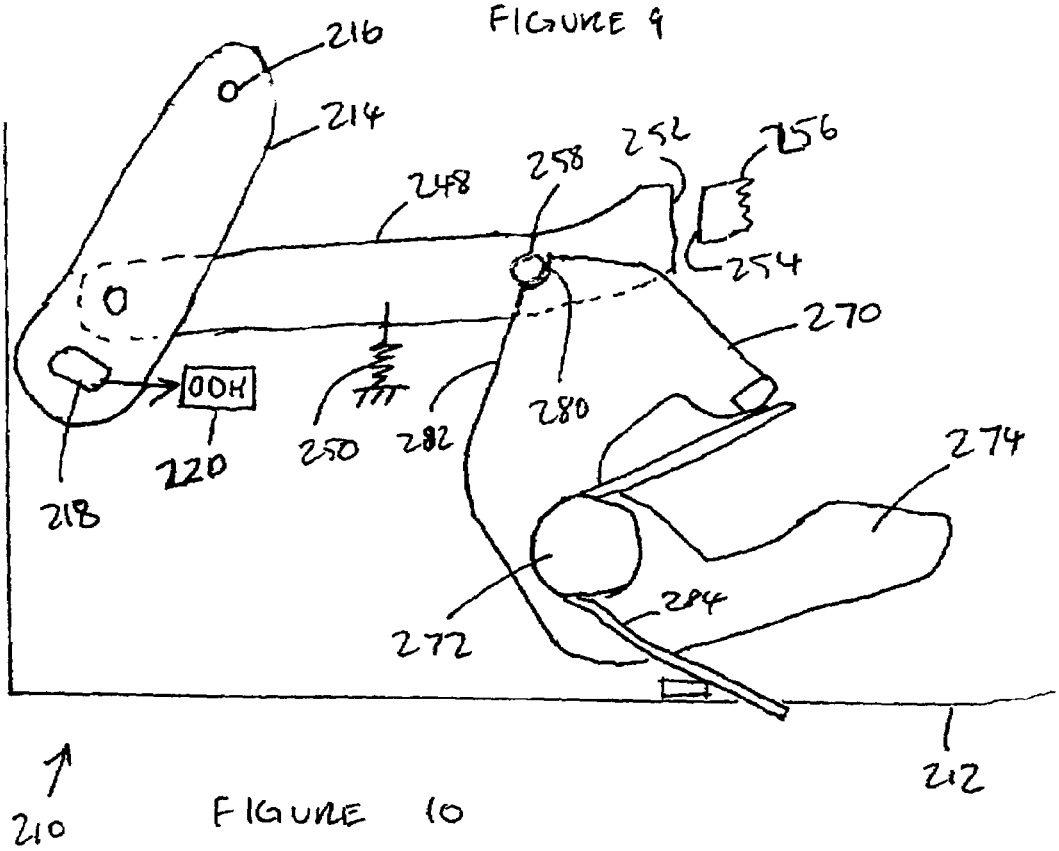
FIG. 10 is a schematic view of a latch mechanism according to another embodiment of the present invention showing a linkage in a rest position.
Figure 11:
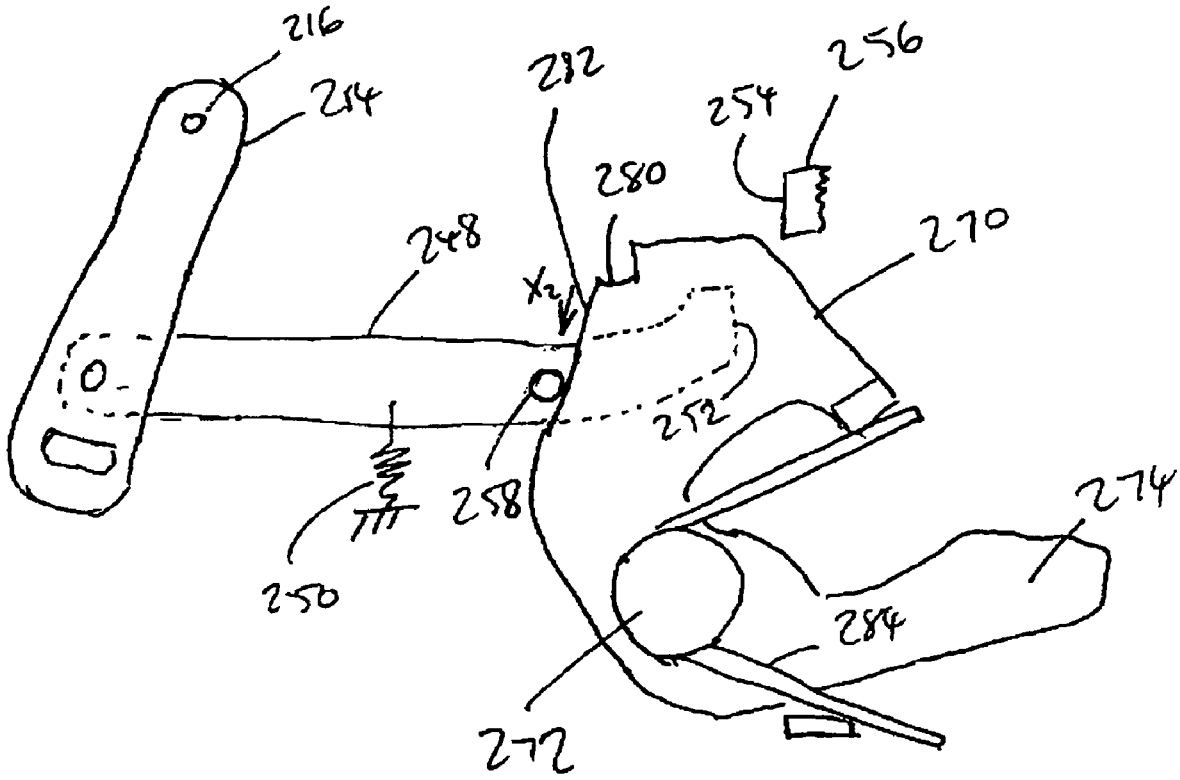
FIG. 11 shows the linkage of FIG. 10 in a locked condition.

FIGS. 10 and 11 illustrates a third embodiment of the present invention in which like parts have again been designated by like numerals, but with the addition of the prefix "2". Again, only the differences between this embodiment and the first two embodiments are discussed in detail.

It can be seen that in this embodiment, the slots 60 and 160 of the first two embodiments have been dispensed with. Instead, a projection 258 on the transmission lever 248 rests in normal use in a notch 280 provided on the inertia body 270. When a user pulls on the outside door handle 220, the transmission lever 248 moves from left to right to contact the actuating lever 256 while the projection 258 on the transmission lever 248 is retained within the notch 280. The inertia body 270 rotates during this movement against the biasing force of the torsion spring 284.

During an impact, the inertia body 270 rotates in a clockwise direction in a similar manner to the inertia body 170 of the second embodiment. This causes the projection 258 on the transmission lever 248 to leave the notch 280 and slide against the inertia body 270 in a direction shown by arrow $X_2$ to attain the position shown in FIG. 11. Once the acceleration (e.g., negative acceleration) due to the impact has ceased, the projection 258 is maintained in this position due to an equilibrium of the counter-clockwise biasing force acting on the release lever 214, the clockwise biasing force acting on the transmission lever 248 due to the spring 250, the counter-clockwise biasing force acting on the inertia body 274 due to the torsion spring 284, and the frictional resistance between the projection 258 and the abutment surface 282 of the inertia body 270.

A subsequent pull on the outside door handle 220 causes the inertia body 270 to rotate in a clockwise direction until the frictional resistance between the projection 258 and the surface 282 of the inertia body 270 and the biasing force of spring 250 is overcome so that the projection 258 slides back into the notch 280 on the inertia body 270. However, during this sliding motion and rotation of the inertia body 270, the abutment surface 252 on the transmission lever 248 avoids contacting the abutment surface 254 of the actuating lever 256. The latch 210 will unlatch only after the outside door handle is released, to return the transmission linkage back to the rest position shown in FIG. 10, and then pulled again.

Figure 12:
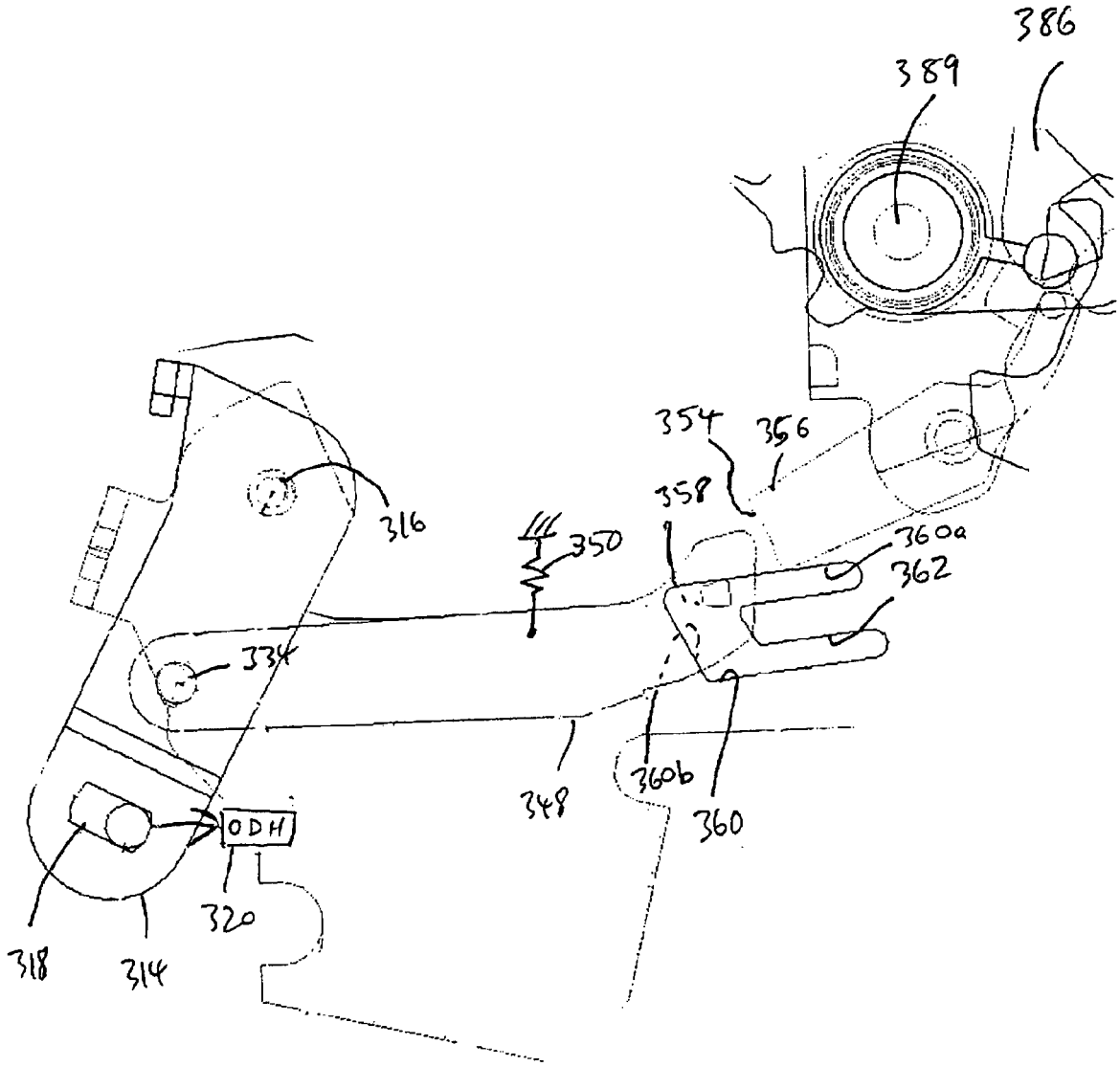
FIG. 12 is a schematic view of a latch mechanism according to a fourth embodiment of the present invention incorporating a transmission linkage shown in a rest position.
Figure 13:
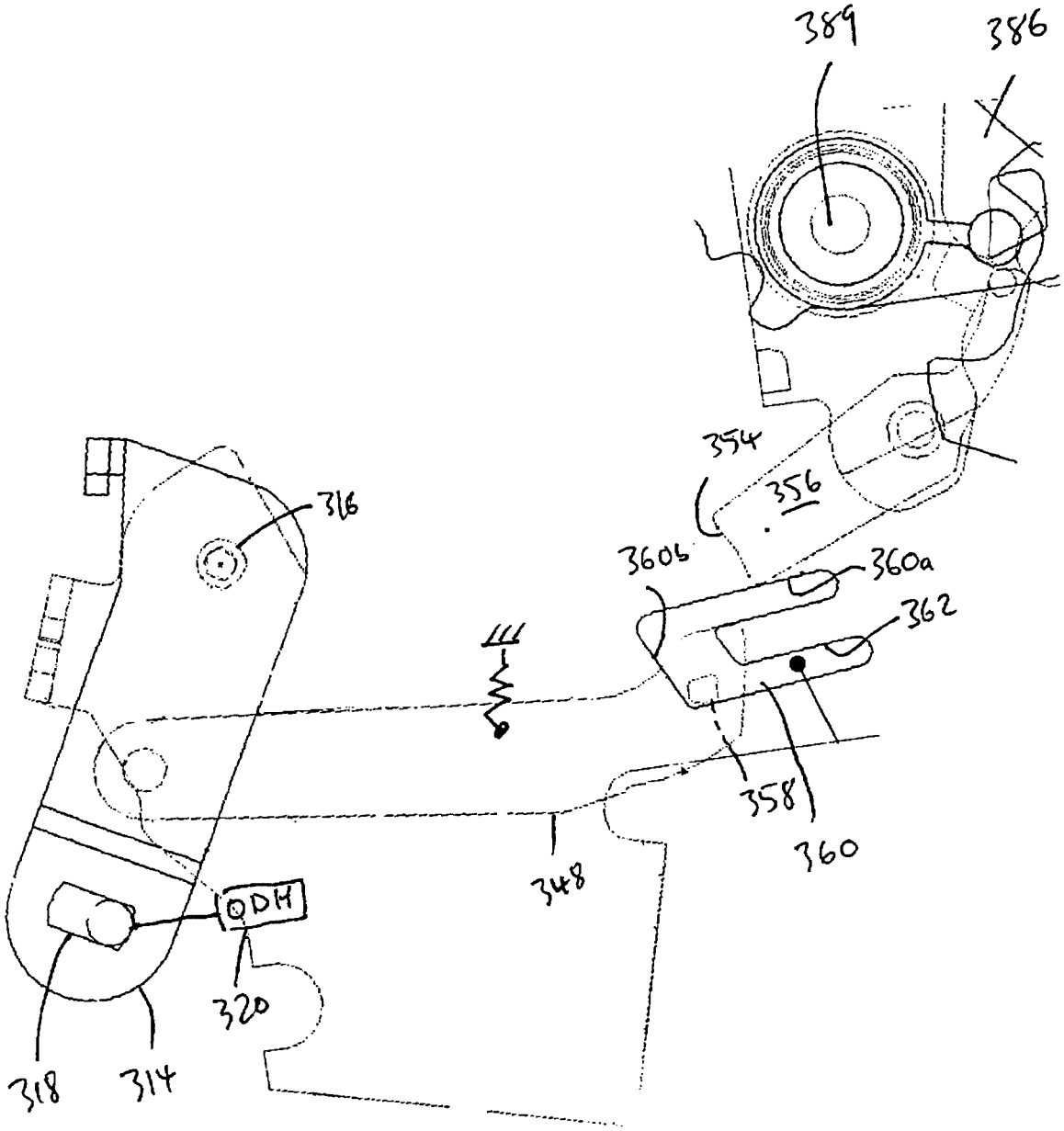
FIG. 13 shows the linkage of FIG. 12 in an activated condition.
Figure 14:
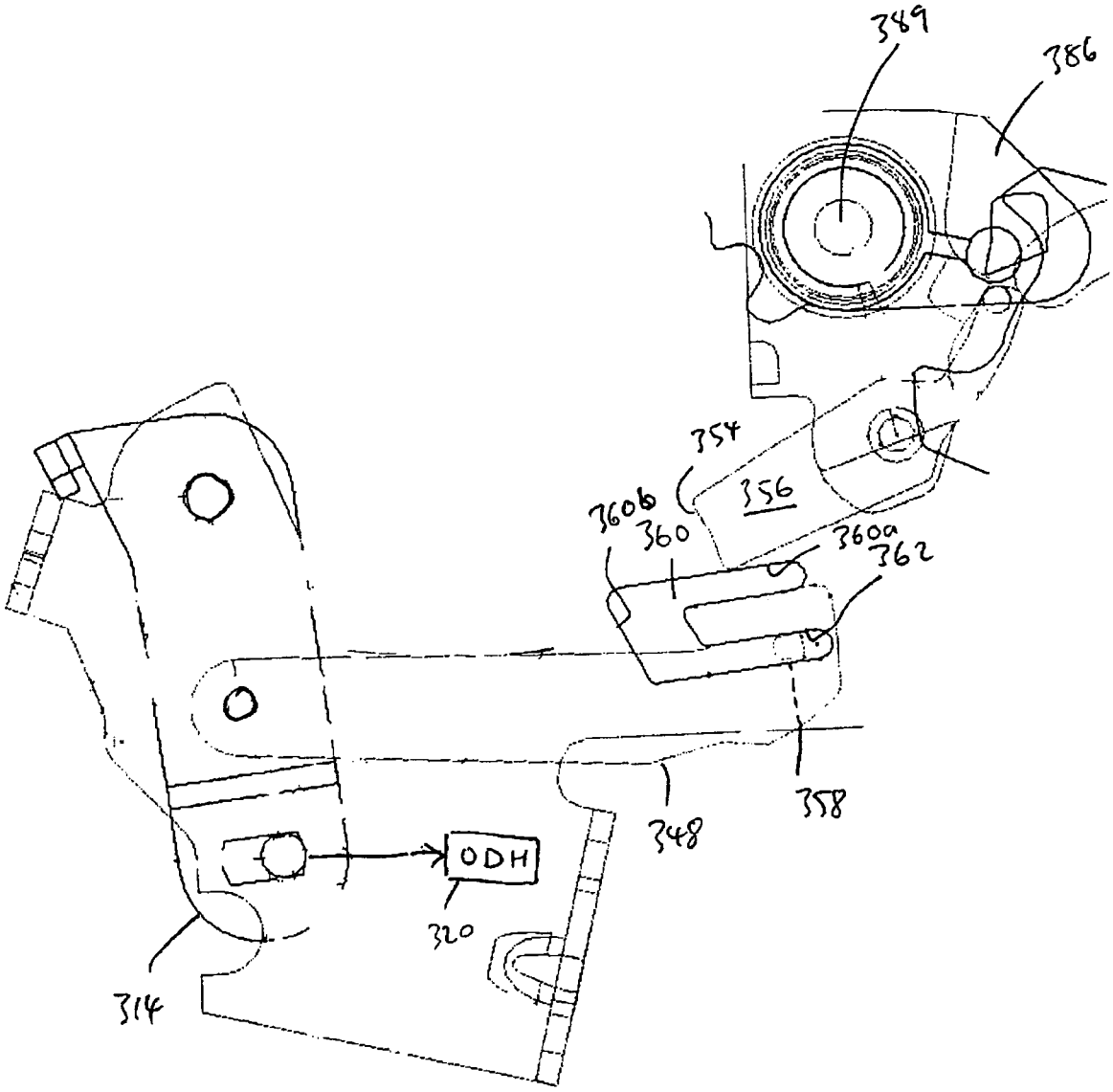
FIG. 14 shows the linkage of FIG. 12 in a full travel position.

FIGS. 12, 13 and 14 illustrate a fourth embodiment of the present invention in which like parts have been designated by like numerals, but with the addition of the prefix "3".

Only differences between this embodiment and the preceding embodiments are discussed in detail.

In this embodiment, the slot 360 has a U-shaped configuration with substantially parallel, spaced linear slot portions 360*a* and 362 joined by a transverse slot portion 360*b*. As such, the slot configuration is similar to the slot configuration of the first embodiment except that the transverse portion 360*b* is angled toward the linear slot portion 362 to encourage the projection 358 on the transmission lever 348 to enter the linear slot portion 362 if the transmission lever 348 pivots from its rest position. However, in this embodiment, the pawl and catch mechanism of the first embodiment is dispensed with. Note that the fourth and fifth embodiments also eliminate a separate inertia body in the latch and use the transmission lever itself to act as the inertia device.

Thus, if an impact occurs to a vehicle on which a latch of this embodiment is fitted, the transmission lever 348 pivots clockwise in the transverse portion 360*b* of the slot as shown in FIG. 13. If there is a simultaneous or near-simultaneous deformation of the door at this point that causes the release lever 314 to pivot counter-clockwise, the projection 358 slides in the linear slot portion 362 as shown in FIG. 14 such that the abutment surface 352 of the transmission lever 348 avoids contacting the abutment surface 354 of the actuating lever 356, preventing the latch from releasing.

Once the acceleration has ceased, the release lever 314 returns to its normal rest position, freeing the projection 358 and allowing the transmission lever 348 to pivot counter-clockwise back to the rest position shown in FIG. 12 so that subsequent pulls on the outside door handle 320 will release the latch.

Figure 14A:
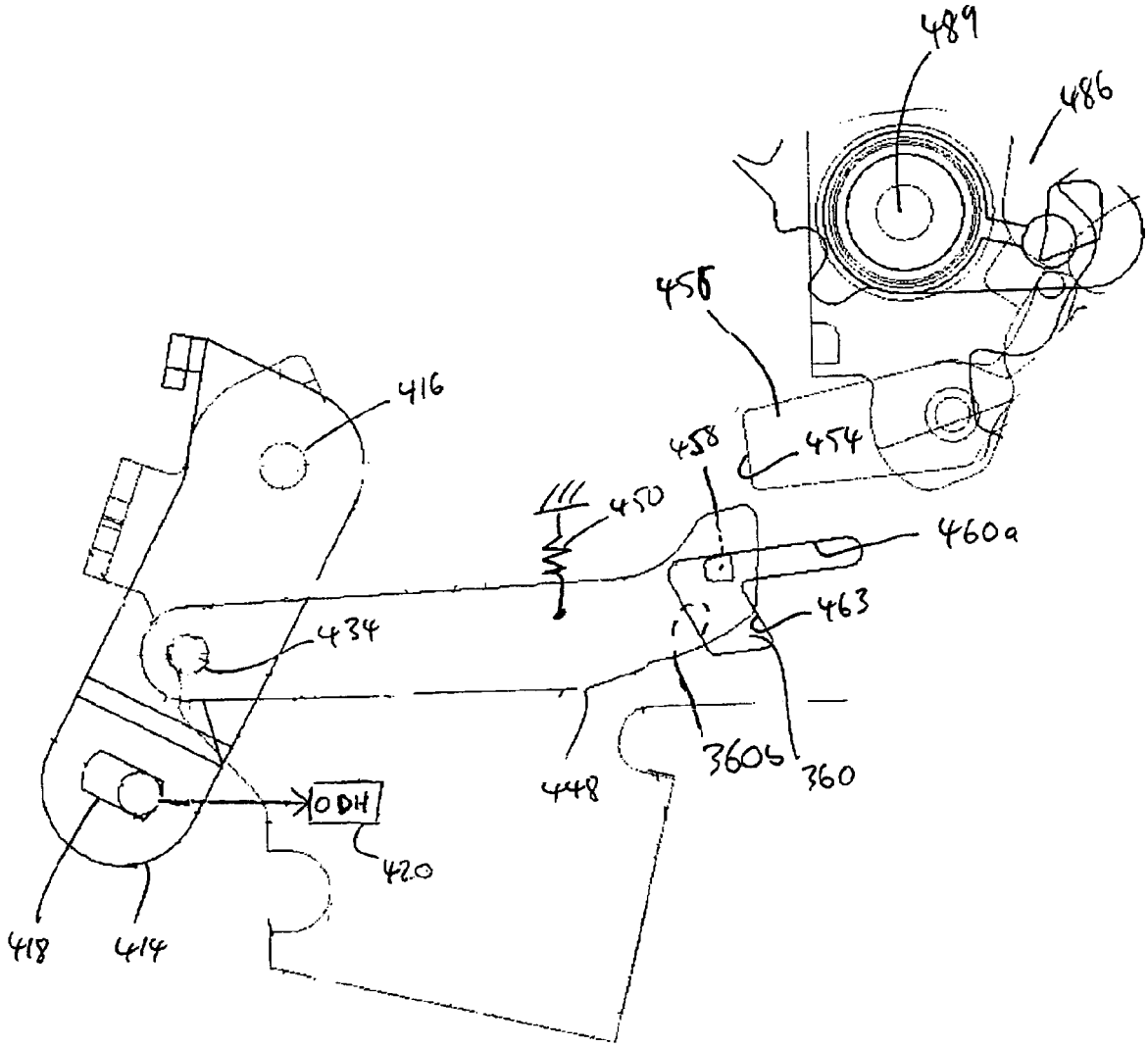
FIG. 14A is a schematic view of a latch mechanism according to another embodiment of the present invention showing a transmission linkage shown in a rest position.

A fifth embodiment of the present invention is shown in FIG. 14A, which is the same as the fourth embodiment except that second linear slot portion 362 is omitted. Thus, if an impact occurs, the transmission lever 448 pivots clockwise. However, any pivoting of release lever 414 is blocked by an abutment surface 463 in the slot, also ensuring that the latch is not released. It should be noted that FIG. 14A shows the actuating lever 456 in a locked position in which the transmission lever 448 is unable to contact the surface 454 of the actuating lever 456 to release the latch.

Figure 18:
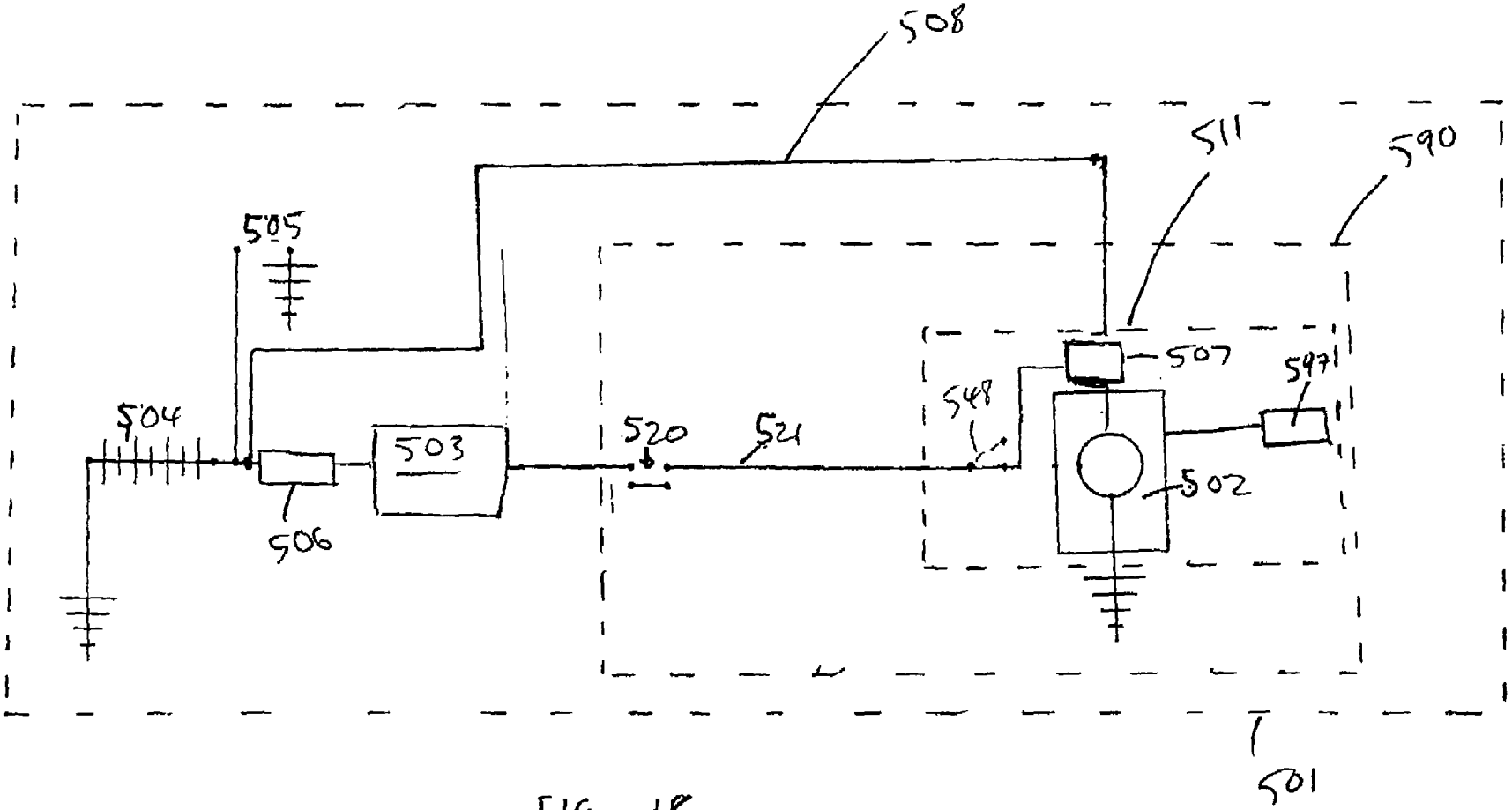
FIG. 18 is a schematic diagram of a vehicle incorporating an electrical inertia locking mechanism according to another embodiment of the present invention.

FIG. 18 illustrates an electrically operated variant of the inventive inertia locking mechanism located in a vehicle 501. Like numerals have, where possible, been used for equivalent components, but with the addition of the prefix "5".

The car 501 includes a battery 504 and an emergency power source 505, either of which may power a controller 503, such as a microprocessor controller, via a resistor 506. The battery 504 and the emergency power source 505 are also capable of powering a motor 502 of the latch 511 via a power circuit 508 and transistor 507 to lift the pawl 597 and thus release a latch bolt (not shown) of the latch.

The controller 503 is connected to a transistor or relay 507 by a signal path 521. The controller 503 determines the locked state of the latch in response to inputs from, for example, remote keyless entry devices, key barrels, or door sill buttons (not shown).

Where the signal path 521 passes through the door, a normally open switch 520 is connected to the door outside handles so that pulling on the handle closes the switch 520.

The signal path 521 further includes an accelerometer-type switch 548 that is normally closed, but which opens when the vehicle is subjected to a transverse acceleration above a predetermined threshold value. The accelerometer 548 may be in the form of a ball-in-tube type device or any other known suitable means of breaking an electrical circuit in response to acceleration above a predetermined level. The accelerometer 548 acts as the inertia body in this embodiment.

As illustrated in FIG. 18, the accelerometer 548 may be incorporated into the latch or may alternatively be provided at any other suitable location on the signal path 521 or the power transmission circuit 508. In other embodiments, the accelerometer may provide an input into controller 503.

In operation, when an impact occurs, the accelerometer, which is normally closed, opens and breaks the signals circuit 521, thus preventing a "high" signal from reaching a relay 507. This prevents the motor 502 from being powered to lift the pawl 597 and release the latch (regardless of the locked condition of latch 511). Once the acceleration ceases, the accelerometer 548 returns to its normally closed position, thus enabling the latch 511 to be released by operation of the outside handle (if unlocked).

While this electrical operation has been described in described in relation to the outside door handle, a similar signal path including an accelerometer may be provided for the signaling of electrical power release from an inside handle.

Where the latch is power unlatched under normal circumstances, but is provided with a mechanical release facility for back-up in the event of an electrical malfunction, the inertia locking system of the sixth embodiment may be combined with one of the mechanical inertia locking mechanisms of any of the first to the fifth embodiments to ensure that unwanted unlatching may not occur either electrically or mechanically in the event of an impact.

It should be appreciated that the various orientations and directions used to describe the position of various components and the movement of components are for ease of reference only. In practice, the latch may be installed in a number of different positions provided the orientation ensures that acceleration or deceleration will result in the latch operating as described above. As such, the terms used in this disclosure should not be construed as limiting.

It will be appreciated that numerous changes may be made within the scope of the present invention. For example, the person skilled in the art will appreciate that numerous alternative configurations of components may be used to achieve a break or freewheel in the transmission path that is subsequently resettable. The inertia of the transmission lever or the separate inertia device (e.g., the inertia body 170) may be adjusted by altering the mass or length of the lever arm. Interchangeable masses may be attached to the transmission lever or inertia body to achieve this. Additionally, components may be provided to block rather than break the transmission pat to interrupt the path. Furthermore, a similar arrangement may be used to provide such a block or break in the transmission path from the inside door handle to the latch bolt, although in normal circumstances it is less likely for deformations of the door in an impact to cause unlatching by virtue of the movement of the inside door handle relative to the latch mechanism. In certain circumstances it may not be necessary for the mechanism to be resettable.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. An inertia locking mechanism for a vehicle door latch, comprising:

a release lever;

a transmission lever acting as an inertia device and including a projection, wherein the transmission lever forms a part of a transmission path that transmits an unlatching movement from the release lever to release a latch bolt of the vehicle door latch, and wherein inertia in the transmission lever causes an interruption in the transmission path in response to an acceleration force above a predetermined level; and a guide structure that controls return of the transmission lever to a normal operating position, wherein the guide structure is a slot disposed on a latch chassis that guides movement of the projection.

2. The inertia locking mechanism of claim 1, wherein the slot has a linear slot portion and an arcuate slot portion.

3. The inertia locking mechanism of claim 1, wherein the slot is substantially U-shaped.

4. The inertia locking mechanism of claim 1, wherein the slot is substantially triangle-shaped.

5. A vehicle door latch mechanism, comprising:

a release lever;

an inertia device operably coupled to the release lever, wherein the inertia device forms at least a part of a transmission path that transmits an unlatching movement from the release lever to release a latch bolt of a vehicle door latch and is displaced relative to a remainder of the latch mechanism in response to an acceleration force above a predetermined level such that the inertia device moves to interrupt the transmission path, wherein the transmission path is restored by actuation of the release lever and includes a transmission lever pivotally mounted to the release lever, the transmission lever including a projection; and a latch chassis, wherein a slot is disposed on the latch chassis to guide movement of the projection.

6. The vehicle door latch mechanism of claim 5, wherein the slot has a linear slot portion and an arcuate slot portion.

7. The vehicle door latch mechanism of claim 5, wherein the slot is substantially U-shaped.

8. The vehicle door latch mechanism of claim 5, wherein the slot is substantially triangle-shaped.

9. The vehicle door latch mechanism of claim 5, wherein the transmission lever acts as the inertia device.

* * * * *